United States Patent [19]

Janssen

[11] Patent Number: 4,815,966

[45] Date of Patent: Mar. 28, 1989

[54] BURNER FOR BURNING LIQUID OR GASEOUS FUELS

[75] Inventor: Hermann-Josef Janssen, Langnau a.A., Switzerland

[73] Assignee: Ing. Gureau Sonvico AG, Langnau a.A., Switzerland

[21] Appl. No.: 157,960

[22] Filed: Feb. 19, 1988

[30] Foreign Application Priority Data

Feb. 26, 1987 [DE] Fed. Rep. of Germany ..... 3706234

[51] Int. Cl.[4] ..... F23C 5/00

[52] U.S. Cl. ..... 431/174; 431/115; 431/285; 431/352

[58] Field of Search ..... 431/174, 175, 177, 285, 431/115, 116, 351, 352

[56] References Cited

U.S. PATENT DOCUMENTS 4,347,052 8/1982 Reed et al. ..... 431/188

4,575,332 3/1986 Oppenberg et al. ..... 431/351

*Primary Examiner*—Carroll B. Dority, Jr.

*Attorney, Agent, or Firm*—Max Fogiel

[57] ABSTRACT

A burner for burning liquid or gaseous fuels, especially heavy heating oil. A central fuel lance is surrounded by two annular channels that supply primary and secondary combustion air. The annular channels are surrounded by several outer fuel lances that are distributed along the arc of a circle and can optionally be displaced axially and by air nozzles that convey tertiary combustion air. The object is to burn fuel at a low output of pollutants in systems with a narrow combustion space. The burner has an annular flue-gas channel between the outer annular channel and the air nozzles. The burner opens into a chamber that is jacketed in ceramic and that a heat exchanger (flame tube) extends out of. Other nozzles that convey a component of the flow of tertiary air are mounted in the wall of the chamber.

8 Claims, 2 Drawing Sheets

BURNER FOR BURNING LIQUID OR GASEOUS FUELS

BACKGROUND OF THE INVENTION

The invention concerns a burner for burning liquid or gaseous fuels.

A burner of this type is known (U.S. Pat. No. 4 347 052) in relation to separating the combustion air into primary, secondary, and tertiary air and to supplying the tertiary air through a separate air box in order to decrease the formation of nitrogen oxides during combustion. Supplying flue gas to where the flame begins between the release of the primary air and of the secondary air in burners with a central oil lance and a tripartite air release is also known (German OS No. 3 327 597). Problems sometimes occur, however, in the known burners that are equipped with a central fuel lance and operate with heavy oil when they operate in a narrow burner space, in a fire-tube three-pass boiler for example, in that low-pollutant combustion can be associated with an impermissibly high ejection of solids.

SUMMARY OF THE INVENTION

The object of the invention is to improve a generic burner of the aforesaid type to the extent that the formation of nitrogen oxides will be considerably reduced, especially when heavy heating oil is being burned, while maintaining a prescribed solids-ejection level.

The graduated supply of tertiary air and the release of the veil of flue gas between the secondary and tertiary air decelerates combustion and prevents high flame temperatures, counteracting the formation of nitrogen oxides. This type of combustion, which is so beneficial in its suppression of nitrogen oxides, however, increases the hazard of an undesired level of solids production due to what are called unconsumed carbon components, during the combustion of heavy heating oil in particular. Since the fireproof-jacketed chamber, then, extensively terminates oxidation, the first intermediate products to occur and such incomplete-combustion products as carbon monoxide, soot, and hydrogen are burned up at the end of the chamber, and flue gas can cool in a heat exchanger immediately adjacent to the chamber. The backup ring at the end of the chamber produces turbulence in the combustion products and accelerates complete combustion of the fuel. The burner in accordance with the invention is outstanding, especially when employed to burn heavy heating oil and in plants with narrow combustion chambers, in that the prescribed limits for the ejection of gaseous pollutants like nitrogen oxide and carbon monoxide and of solid pollutant can be kept uniform.

One embodiment of the invention will now be described with reference to the drawings, wherein

DESCRIPTION OF THE PREFERRED EMBODIMENT

Figure 1:
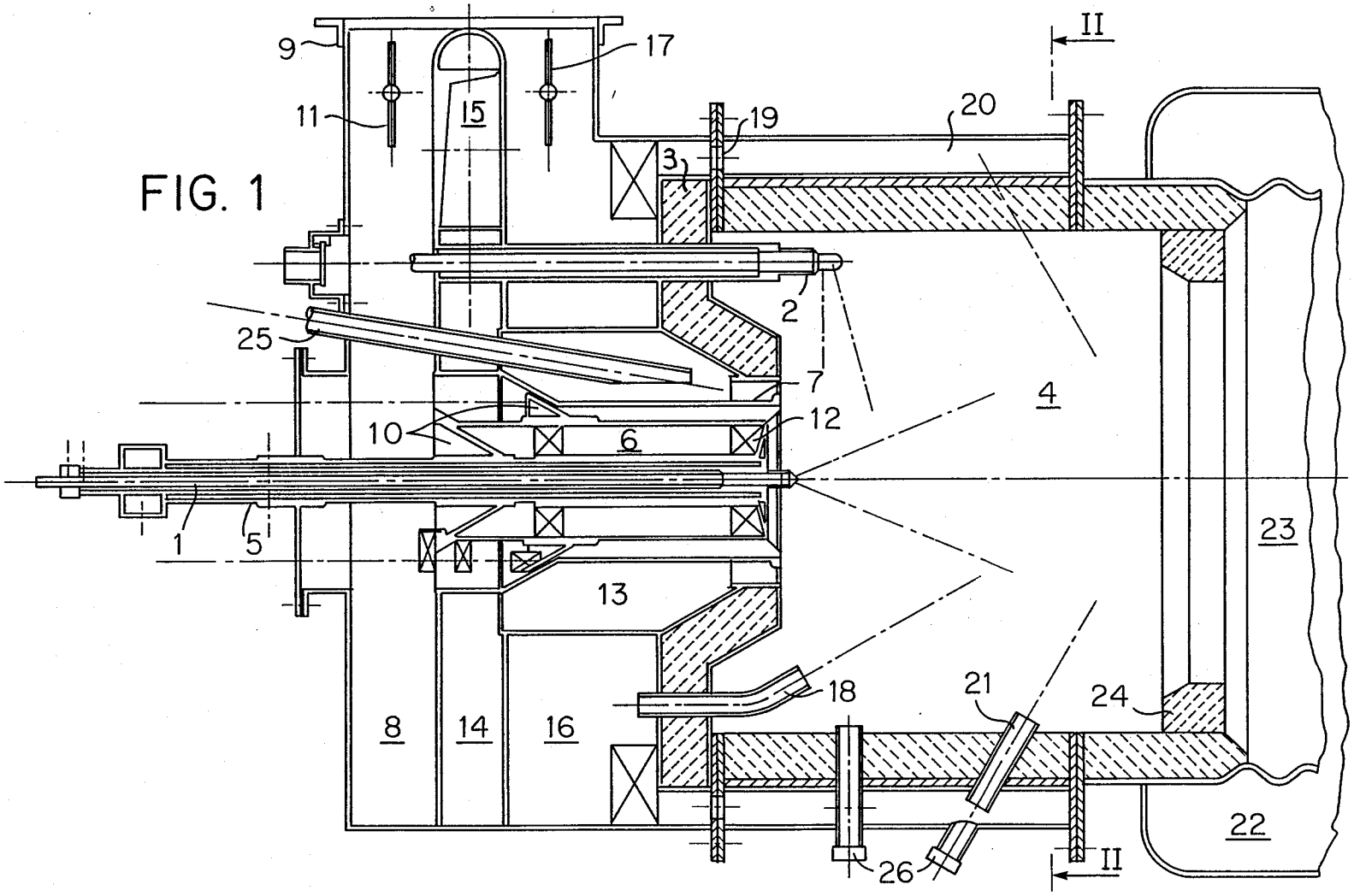
FIG. 1 is a longitudinal section through a burner in accordance with the invention and FIG. 2 is a section along the line II—II in FIG. 1.

The burner contains several fuel lances, specifically a central lance 1 and several, three in the present case, satellite lances 2, that surround the central lance in the sector of a circle. Central lance 1 and satellite lances 2 enter into a fireproof-jacketed chamber 4 that has a front wall 3. The fuel lances can be oil lances or gas lances and burn liquid or gaseous fuel. All of the lances can be shifted axially.

This burner is intended for the low-pollutant burning of heavy heating oil in narrow combustion spaces in particular. An interior mixer is employed as a vaporizing lance for the liquid fuel. The vaporizing agent can be compressed air or steam. The fuel is broken up into parts in such a way that each lance is evenly provided with fuel—with $100\%/(n+1)$ of the total amount of fuel, that is, in the case of one central lance and n satellite lances. The fuel is injected through central lance 1 through uniformly distributed nozzle openings, with the angle of spray matching the design of chamber 4. The fuel flows out through the satellite lances 2 in one direction through a sequence of several nozzle bores. The jet from the satellite lances 2 can be directed to the center of or at a tangent to any imaginary circle inside chamber 4. The injection position can also be displaced axially. The fuel is distributed among central lance 1 and satellite lances 2 in such a way as to prevent coking and accelerate the gasification of the fuel. The variable and graduated fuel injection maintains the local flame temperatures and oxygen concentration as low as possible, counteracting the formation of thermal nitrogen oxide and fuel nitrogen oxide.

Central lance 1 is surrounded by a guard pipe 5 that is in turn surrounded by two annular channels 6 and 7 that communicate with an air chamber 8. The combustion air, which enters through air chamber 8 and through an air-intake connection 9, is divided by annular channels 6 and 7 into an interior flow of primary air and an exterior flow of secondary air. Accommodated in the intake into annular channels 6 and 7 are air baffles 10 that can be shifted axially by a system of rods at the rear and can be employed to adjust the ratio of the pressure of the airflow to its speed. Accommodated in the intake into an air box 88 is a flap 11 that controls the amount of combustion air supplied to annular channels 6 and 7. Mounted on the backup ring 5 that surrounds central lance 1 and at the outlet end of inner annular channel 6 is a swirler 12 that generates turbulence in the flow of primary air.

Outer annular channel 7, which channels the secondary air, is surrounded by an annular flue-gas channel 13 that communicates with a separate flue-gas intake connection 15 through a flue-gas chamber 14. Flue gas is extracted by a fan from the boiler connected to the burner and is supplied to flue-gas intake connection 15. The flue gas enters chamber 4 through annular flue-gas channel 13, forming over a certain section of its path an envelope around the jet of fuel emerging from central lance 1 and around the jets of primary and secondary air.

Another air chamber 16 communicates with air-intake connection 9, from which it is separated by flue-gas chamber 14, and supplies another component of the flow of combustion air in the form of tertiary air. Accommodated in the intake into second air chamber 16 is a flap 17 that controls the amount of entering air. In the front wall 3 of chamber 4 is a set of air nozzles 18 that open into second air chamber 16 with one end, which is straight or bent at an angle to the longitudinal axis of the chamber, extenting into the chamber. The outlets of air nozzles 18 are distributed around the arc of a circle with a diameter that is shorter than that of the arc of satellite lances 2 and longer than that of the outlet from annular flue-gas channel 13. The outlets of air nozzles 18 are also upstream of the nozzle bores in satellite lances 2 along the direction that the flue gas flows in.

Figure 2:
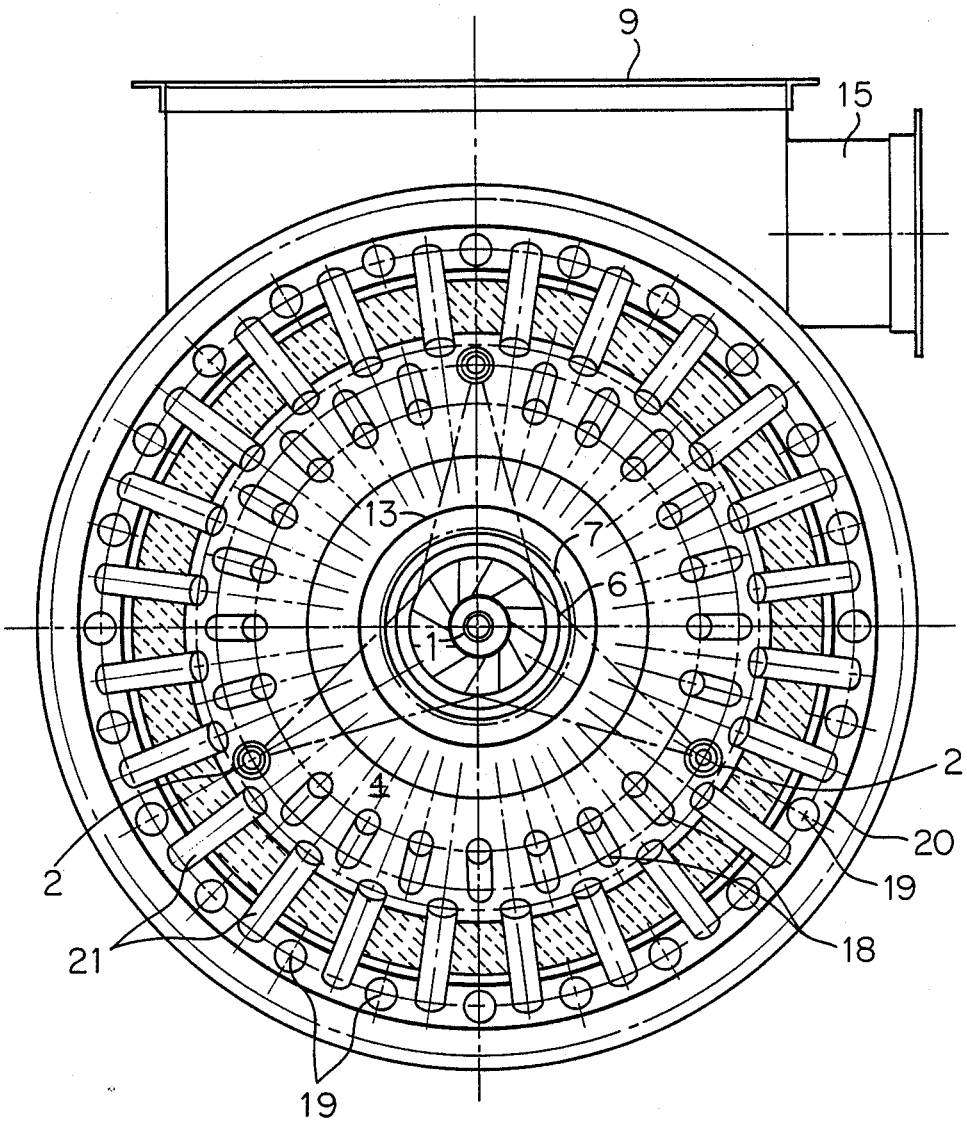

Second air chamber 16 communicates through a series of access bores 19 with an annular chamber 20 that surrounds chamber 4. Positioned at a distance from the outlets of air nozzles 18 and the nozzle bores of satellite lances 2 and extending at an angle through the wall of chamber 4 are other nozzles 21 that empty into annular chamber 20 and extend into chamber 4. The outlets of nozzles 21 are distributed along the arc of a circle that has a diameter longer than that of the arc that satellite lances 2 are distributed along. The combustion air supplied to second air chamber 16 is supplied in the form of tertiary air I through air nozzles 18 and, at a distance therefrom, in the form of tertiary air II through further nozzles 21 to chamber 4. The direction followed by jets of air leaving air nozzles 18 and nozzles 21 is represented in the drawing by the dot-and-dash line. It will be evident from FIGS. 1 and 2 that the jets of tertiary air are at a spatial angle to the longitudinal axis of chamber 4.

The graduated supplies of fuel and air in chamber 4 plus the introduced flue gas decelerate combustion and prevent high flame temperatures. The fireproof jacketing of chamber 4 decreases, in conjunction with this type of combustion, the amount of heat flowing out to the extent that combustion will be extensively complete at the end of chamber 4.

The flame tube 23, cooled by a water jacket 22, of an internal-flue boiler is connected directly to the outlet end of chamber 4. The combustion products leaving chamber 4 are accordingly immediately cooled.

Positioned at the outlet end of the fireproof-jacketed chamber 4 is a backup ring 24 composed of segments of stone. Backup ring 24 creates a constricted zone, generating additional turbulence in the combustion products and accordingly accelerating complete consumption of the fuel. The combustion process can be affected by positioning backup ring 24 at different points along chamber 4. When it is closer to the burner lances, the additional nozzles 21 that inject tertiary air II can also be positioned upstream of backup ring 24 along the direction that the flue gas flows in.

Extending through air boxes 8 and 18 and flue-gas chamber 14 are mutually displaced pipes 25, only one of which is illustrated. Pipes 25 accommodate a gas-ignition burner, monitor the flame, or function as observation openings. Other observation openings empty into chamber 4.

Although the present invention has been described with reference to one or more embodiments by way of example, it is in no way to be considered confined to them, and various alternatives will be evident to one of skill in the art that do not exceed its scope.

I claim:

1. A burner arrangement comprising: a chamber means having a ceramic jacket; a central fuel lance surrounded by means forming two annular channels supplying primary and secondary combustion air mounted in one end of said chamber means; a plurality of outer fuel lances mounted in said one end of said chamber means and distributed along an arc of a circle and surrounding said annular channels, means mounting said outer fuel lances for displacing axially; first air nozzles mounted in said one end of said chamber means for conveying tertiary combustion air; means forming an annular flue-gas channel in said one end of said chamber means between one of said annular channels and said air nozzles; heat exchanger means connected to an opposite end of said chamber means; second nozzles mounted in a wall of said chamber means downstream of said first air nozzles and conveying a component of the tertiary air flow.

2. A burner arrangement as defined in claim 1, wherein the fuel to be burned is distributed between said central fuel lance and said outer fuel lances.

3. A burner arrangement as defined in claim 1, wherein said outer fuel lances have nozzle bores pointing toward interior of said chamber means.

4. A burner arrangement as defined in claim 1, wherein said first air nozzles are distributed along an arc of a circle having a diameter which is less than the diameter of said arc of the circle along which said outer fuel lances are distributed, said second nozzles having outlets distributed along an arc of a circle with diameter greater than the diameter of said arc of the circle along which said outer fuel lances are distributed.

5. A burner arrangement as defined in claim 1 including backup ring means abutting against an inner wall surface of said chamber means.

6. A burner arrangement as defined in claim 5, wherein said backup ring means is positioned at an end of said chamber means.

7. A burner arrangement as defined in claim 5, wherein said second nozzles are positioned on a side of said backup ring means facing said fuel lances.

8. A burner arrangement as defined in claim 1, wherein said chamber means has a longitudinal axis, said first nozzles and said second nozzles having emerging jets of air oriented at a spatial angle to said longitudinal axis of said chamber means.

* * * * *